United States Patent [19]

Heeren et al.

[11] 4,308,913

[45] Jan. 5, 1982

[54] COOLING TOWER WITH ELEVATED HEAT EXCHANGER ELEMENTS SUPPORTED ON GIRDERS

[75] Inventors: Hermann Heeren, Nuremberg; Dietrich Richter, Neustadt, both of Fed. Rep. of Germany

[73] Assignee: Maschinenfabrik Augsburg-Nürnberg Aktiengesellschaft, Nuremberg, Fed. Rep. of Germany

[21] Appl. No.: 59,302

[22] Filed: Jul. 20, 1979

[30] Foreign Application Priority Data

Jul. 25, 1978 [DE] Fed. Rep. of Germany ..... 2832498

[51] Int. Cl.[3] ..... F28F 9/00

[52] U.S. Cl. ..... 165/68; 165/82; 248/DIG. 1; 261/DIG. 11

[58] Field of Search ..... 165/81, 82, 67, 68, 165/178, 162; 248/560, 618, 622, DIG. 1; 261/DIG. 11

[56] References Cited

U.S. PATENT DOCUMENTS

| | | | |
|---|---|---|---|
| 2,237,903 | 4/1941 | Drake | 165/68 |
| 2,464,356 | 3/1949 | Stearns | 248/DIG. 1 |
| 2,475,109 | 7/1949 | Pendleton | 248/DIG. 1 |
| 3,345,048 | 10/1967 | Phelps | 261/DIG. 11 |
| 3,447,598 | 6/1969 | Kaess | 165/67 |
| 3,459,258 | 8/1969 | Wagner | 165/67 |
| 3,601,343 | 8/1971 | Sivaslian | 248/637 |
| 3,851,626 | 12/1974 | Boyd et al. | 165/82 |
| 4,036,461 | 7/1977 | Soligno | 165/162 |
| 4,042,651 | 8/1977 | Gaurois | 261/DIG. 11 |
| 4,050,660 | 9/1977 | Eggmann et al. | 248/DIG. 1 |

FOREIGN PATENT DOCUMENTS

| | | | |
|---|---|---|---|
| 2541167 | 3/1977 | Fed. Rep. of Germany | 248/DIG. 1 |
| 808739 | 2/1959 | United Kingdom | 248/DIG. 1 |
| 451885 | 4/1975 | U.S.S.R. | 248/DIG. 1 |

*Primary Examiner*—Daniel J. O'Connor
*Attorney, Agent, or Firm*—Becker & Becker, Inc.

[57] ABSTRACT

Lattice-type supporting structures with girders on which heat exchanger elements of rectangular or square cross section are supported. Typically air/tube dry cooling elements for cooling towers are disclosed. The heat exchanger elements are supported by stilts on the girders at a distance thereabove, with the stilts extending perpendicular to the supporting surface of girders. The stilts are mounted on girders in a manner making them immovable in a direction perpendicular to their longitudinal axis. The stilts have a high flexibility in bending permitting free expansion or contraction of each heat exchanger element or each heat exchanger element group with a plurality of elements combined into an integral unit under conditions of changing temperatures.

2 Claims, 2 Drawing Figures

COOLING TOWER WITH ELEVATED HEAT EXCHANGER ELEMENTS SUPPORTED ON GIRDERS

The present invention relates to cooling towers and, more particularly, to supporting structures for heat exchanger elements in cooling towers, especially air/-tube dry cooling elements of rectangular or square cross-section.

If such heat exchanger elements were to bear directly, i.e. without a clearance, on the cross girders associated therewith, the cooling fluid, cooling air or cooling gas, would not flow through those flow passages which would be provided in the region where the heat exchanger elements overlap the cross girder therewith. This would result in a drawback inasmuch as either the heat transfer performance would be lowered, or—if the flow of cooling fluid were to be kept constant—a pressure loss for the cooling fluid would occur.

It is an object of this invention, on the one hand, to support the heat exchanger elements on the supporting structure without obstructing the flow passages and, on the other hand, to allow for the thermal expansion of the elements without subjecting the lattice structure to any major forces.

Figure 1:
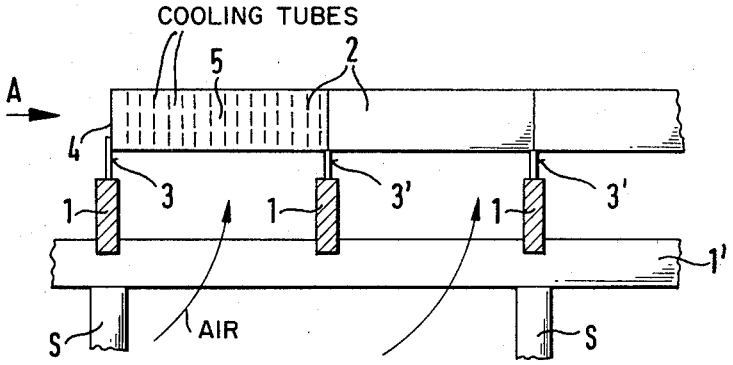
Figure 2:
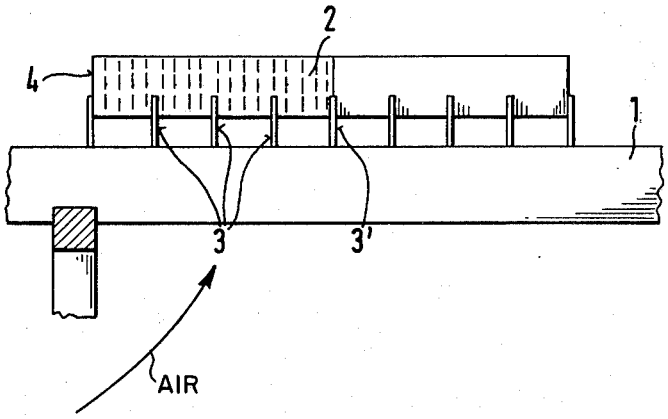

This object and other objects and advantages of the invention will appear more clearly from the following specification in connection with the accompanying drawing, in which:

FIG. 1 is a partially sectioned diagrammatical view of a portion of the heat exchanger elements in the direction of the flow of the fluid to be recooled; and FIG. 2 is a side view in the direction of the arrow A in FIG. 1.

The supporting structure according to one aspect of the invention is characterized primarily therein that the heat exchanger elements are supported by stilts on girders at a distance above the girders, with the stilts extending perpendicularly to the supporting surface of the girders associated therewith. The stilts are mounted on the girders in a manner making them immovable in a direction perpendicular to their longitudinal axis, and the stilts have a high flexibility in bending permitting free expansion or contraction under conditions of heating or cooling of each heat exchanger element and/or each heat exchanger unit including a plurality of elements to form an integral entity.

According to another aspect of the invention, the stilts or a portion of the stilts, in the case of a cooling tower equipped with air/tube dry cooling elements throughout, are formed by members of a pentagonal or hexagonal cross-section which are provided in place of cooler tubes.

Referring now particularly to the drawing, a lattice-type supporting structure for a heat exchanger element 2 comprises main girders 1' and cross girders 1 and is supported by vertical columns S. The cross girders 1 are supported on the main girders 1' and, in turn, indirectly support the horizontally arranged heat exchanger elements 2 by means of vertical stilts 3, 3'. The stilts 3, 3' are mounted immovably in a direction perpendicular to their longitudinal axis on the cross girders 1.

The heat exchanger elements 2 can be, for example, air/tube dry cooling elements, e.g. generally box-shaped elements of rectangular cross-section, when viewed in a direction perpendicular to the cross girders 1. The elements 2 are generally formed with bottom, top and side walls. Within an element 2, between the bottom and top walls thereof, in a direction perpendicular to these walls, there extend cooling air tubes, not shown, through which cooling air is conveyed. The fluid to be recooled is in contact with the outside of the tubes. The elements are also furnished with supply and discharge pipes or ducts for the fluid to be recooled, typically water or steam. The heat exchanger elements 2 may be arranged individually with a clearance between adjacent elements, or individual elements may be combined to form groups of elements (modular units), as is indicated in FIGS. 1 and 2.

In the embodiment indicated in the drawing, the stilts 3 are secured to the outer side walls 4 of the groups of elements. The stilts 3' are provided by hexagonal or pentagonal bars in the region of the adjoining walls or surfaces of two heat exchanger elements 2 when partitions are omitted, with the selected profiled member replacing certain cooling tubes, not shown. The pentagonal bars can be obtained from suitably bisected members so that a straight surface for assembly is obtained.

The foot ends of the stilts 3, 3' may be fixedly or movably secured to the cross girders 1, or in a manner to allow removal, e.g. by bolted connections. The stilts 3, 3' may also be secured on the outside of elements associated therewith at the face wall 5, at a desired distance away from the contact edge of two adjacent heat exchanger elements 2, e.g. of the center. The stilts 3, 3' are formed and mounted so as to provide a high flexibility in bending so that the entire group of elements 2 is capable of free expansion relative to the supporting structure, with the foot ends of the stilts 3, 3' forming fixed points, in the event of temperature changes. This flexibility in bending, in addition to the selection of a stilt section with a low axial polar moment of inertia, can be obtained by appropriately lengthening the stilts 3, 3'.

Since the heat exchanger elements are now arranged with a suitable clearance relative to the top level of the cross girders, cooling fluid flows through all existing flow passages. Furthermore, the stilts have a high total flexibility.

The present invention is, of course, in no way restricted to the specific disclosure of the specification and drawing, but also encompasses any modifications within the scope of the appended claims.

What we claim is:

1. A support arrangement in combination with heat exchanger elements of dry cooling towers, said dry cooling towers including air/tube dry cooling elements of rectangular or square cross-section including vertical tubes all having air flowing unhindered therethrough as arranged directly above transverse supports and liquid flowing externally of the tubes, said arrangement comprising in combination:

a plurality of girder members with at least some of said girder members having a supporting surface; and support means for vertically supporting heat exchanger elements associated therewith, said support means being operatively connected to heat exchanger elements belonging therewith and vertically unshiftably rigidly connected to girder members associated therewith, said support means extending perpendicular to supporting surfaces of girders having a supporting surface associated therewith, and said support means having a high flexibility in bending for permitting free expansion or contraction of heat exchanger elements arranged therewith wherein said support means includes stilts and wherein said plurality of girders is arranged in a lattice-type support structure, said support structure being provided at a predetermined vertical height.

2. A cooling tower in combination according to claim 1, wherein said heat exchanger elements comprise only air/tube dry cooling elements exclusively therewith.

* * * * *